US011807967B2

(12) United States Patent
Beyou et al.

(10) Patent No.: US 11,807,967 B2
(45) Date of Patent: Nov. 7, 2023

(54) SEWING ASSEMBLY AND METHOD

(71) Applicant: FAURECIA INTERIEUR INDUSTRIE, Nanterre (FR)

(72) Inventors: Régis Beyou, La Canada-Paterna (ES); Juan Medina Galarza, Valencia (ES); Juan Soriano Ponce, Valencia (ES)

(73) Assignee: FAURECIA INTERIEUR INDUSTRIE, Nanterre (FR)

( * ) Notice: Subject to any disclaimer, the term of this patent is extended or adjusted under 35 U.S.C. 154(b) by 165 days.

(21) Appl. No.: 17/239,578

(22) Filed: Apr. 24, 2021

(65) Prior Publication Data

US 2021/0332516 A1 Oct. 28, 2021

(30) Foreign Application Priority Data

Apr. 24, 2020 (FR) ..... 20 04107

(51) Int. Cl.
*D05B 35/02* (2006.01)

(52) U.S. Cl.
CPC ..... *D05B 35/02* (2013.01)

(58) Field of Classification Search
CPC ..... D05B 29/06; D05B 21/00; D05B 39/00; D05B 35/02; D05B 55/06; D05B 73/12; D05B 97/00; D05B 35/06; D05C 5/00; D05C 9/04
See application file for complete search history.

(56) References Cited

U.S. PATENT DOCUMENTS 3,358,626 A * 12/1967 Bryan ..... D05B 21/00 112/102
3,749,038 A * 7/1973 Dodsworth ..... D05B 39/00 112/470.16
3,855,955 A * 12/1974 Strang ..... D05B 39/00 112/152
3,889,614 A * 6/1975 Nicolay ..... D05B 35/10 112/318
4,008,672 A * 2/1977 Cianciotti ..... D05B 39/00 112/470.07

(Continued)

FOREIGN PATENT DOCUMENTS

EP 0753616 A2 1/1997
FR 2627196 A1 * 8/1989 ..... D05B 21/00

(Continued)

OTHER PUBLICATIONS

French Search Report corresponding to French Application No. FR 2004107, dated Jan. 14, 2021, 2 pages.

*Primary Examiner* — Patrick J. Lynch
(74) *Attorney, Agent, or Firm* — REISING ETHINGTON P.C.

(57) ABSTRACT

A sewing assembly to make a seam along a determined path on a surface of a part. The sewing assembly includes a mask adapted to be fixed to the part and a sewing machine, the mask having a guide groove adapted to be superimposed on the path. The sewing machine includes a base and a head. The head has at least one needle, a part support foot and a guide, the guide including a front guide and a rear guide arranged to interact with the mask and spaced apart from each other along the guide groove. The at least one needle and the support foot are engaged in the groove between the front guide and the rear guide.

19 Claims, 3 Drawing Sheets

(56) References Cited

U.S. PATENT DOCUMENTS

| | | | | | |
|---|---|---|---|---|---|
| 4,230,055 | A * | 10/1980 | Kaempfer | ..... | D05B 39/00 112/227 |
| 4,928,609 | A * | 5/1990 | Kawasaki | ..... | D05B 39/00 112/148 |
| 5,544,602 | A * | 8/1996 | Kawasaki | ..... | D05B 21/00 112/148 |
| 5,778,811 | A | 7/1998 | Gill et al. | | |
| 6,997,125 | B1 * | 2/2006 | Kobayashi | ..... | D05B 21/00 112/153 |

FOREIGN PATENT DOCUMENTS

| | | | |
|---|---|---|---|
| GB | 2347690 | A | 9/2000 |
| JP | S5054455 | A | 5/1975 |

* cited by examiner

SEWING ASSEMBLY AND METHOD

TECHNICAL FIELD

The present invention relates to the sewing of parts, particularly decorative parts for vehicles.

BACKGROUND

In cases where it is necessary to perform the sewing with a small positional tolerance, it is possible to use Computer Numerical Control (CNC-controlled) sewing machines. This is the case, for example, when the seams have to be sewn exactly to a pattern on the part.

CNC sewing machines are expensive.

SUMMARY

In this context, one aim of the invention is to provide a sewing assembly that enables seams to be produced with a low positional tolerance, and which is more economical.

To this end, the invention according to a first aspect relates to a sewing assembly for sewing along a predetermined path on a surface of a part, the sewing assembly comprising a mask adapted to be fixed to the part and a sewing machine, the mask having a longitudinally elongated through guide groove adapted to be superimposed on said path, the sewing machine comprising:

- a base;
- a head arranged above the base, the part fitted with the mask being adapted to be received between the base and the head with the mask turned towards the head, the head comprising at least one needle, a part support foot and a guide, the guide comprising a front guide and a rear guide arranged to interact with the mask and spaced apart along the guide groove, the at least one needle and the support foot being engaged in the groove between the front guide and the rear guide.

The front guide and the rear guide interact with the mask to guide the movement of the part relative to the sewing machine, particularly relative to the head and the at least one needle.

Because there is a guide in front of the needle and a guide behind the needle, the guidance is very precise.

It is not necessary for the part to be guided manually by a very experienced operator for the result to be of good quality.

The sewing machine can advantageously be a traditional industrial machine, without CNC (Computer Numerical Control). The investment cost is thus considerably reduced.

At least some embodiments of the invention can be used on already existing machines, with a moderate cost adaptation of the machines. This adaptation consists in adding the guide on the head of the machine. The guide is an inexpensive mechanical part.

The invention is applicable to a wide range of vehicle trim parts, including thick parts with a thick, rigid substrate layer (PP, ABS, natural fibers) and a decorative layer.

The sewing assembly also comprises one or more of the following features, considered alone or according to all technically possible combinations:

- the front guide and the rear guide are both engaged in the guide groove;
- the groove has a given transverse internal width, the front guide and the rear guide respectively comprising a front slide and a rear slide engaged in the groove and having an external width substantially equal to the internal width of the groove;
- the head comprises two rods arranged on either side of the groove and connecting the front guide and the rear guide to each other, the two rods, the front guide and the rear guide together constituting a rigid frame;
- the sewing machine comprises a part feed mechanism comprising the support foot and a drive configured to press the support foot against the part and move the part longitudinally in a rear direction relative to the base;
- the sewing machine comprises at least one roller to press the part against the base, resting on the mask, preferably two pressure rollers arranged transversely on either side of the groove.

The invention according to a second aspect relates to a sewing assembly and method intended for sewing along a determined path on a part surface, the sewing assembly and method comprising the following steps:

- attaching a mask to the part, the mask having a longitudinally elongated through guide groove superimposed on said path,
- placing the part fitted with the mask in a sewing machine comprising a base and a head arranged above the base, the part fitted with the mask being received between the base and the head with the mask turned towards the head, the head comprising at least one needle, a part support foot and a guide, the guide comprising a front guide and a rear guide interacting with the mask and spaced apart from each other along the guide groove, the at least one needle and the support foot being engaged in the groove between the front guide and the rear guide;
- moving the part and the mask relative to the base and sewing with the at least one needle, the part being guided in its movement by the interaction of the front guide and the rear guide with the mask.

The sewing method also comprises one or more of the following features, considered alone or according to all technically possible combinations:

- the front guide and the rear guide are both engaged in the guide groove, the part being guided in its movement by the interaction of the front guide and the rear guide with the guide groove;
- the part and the mask are moved relative to the base by pressing the part support foot and moving the part and the mask longitudinally in a rear direction relative to the base;
- the part is pressed against the base by at least one pressure roller resting on the mask, preferably two pressure rollers arranged transversely on either side of the groove;
- the part comprises a substrate and a decorative layer covering the substrate and defining said surface.

BRIEF DESCRIPTION OF THE DRAWINGS

Further features and advantages of the invention will be apparent from the detailed description given below by way of indication and not in any way limiting, with reference to the appended figures, in which.

DETAILED DESCRIPTION

The below-described embodiments of an assembly and method of the invention are adapted for sewing in all kinds of parts, and more particularly in parts intended for the automobile.

These parts are typically decorative parts, intended to trim the vehicle interior.

These parts are trims for example, intended to be integrated in the dashboard, the opening doors, the central console or any other part of the vehicle.

Figure 1:
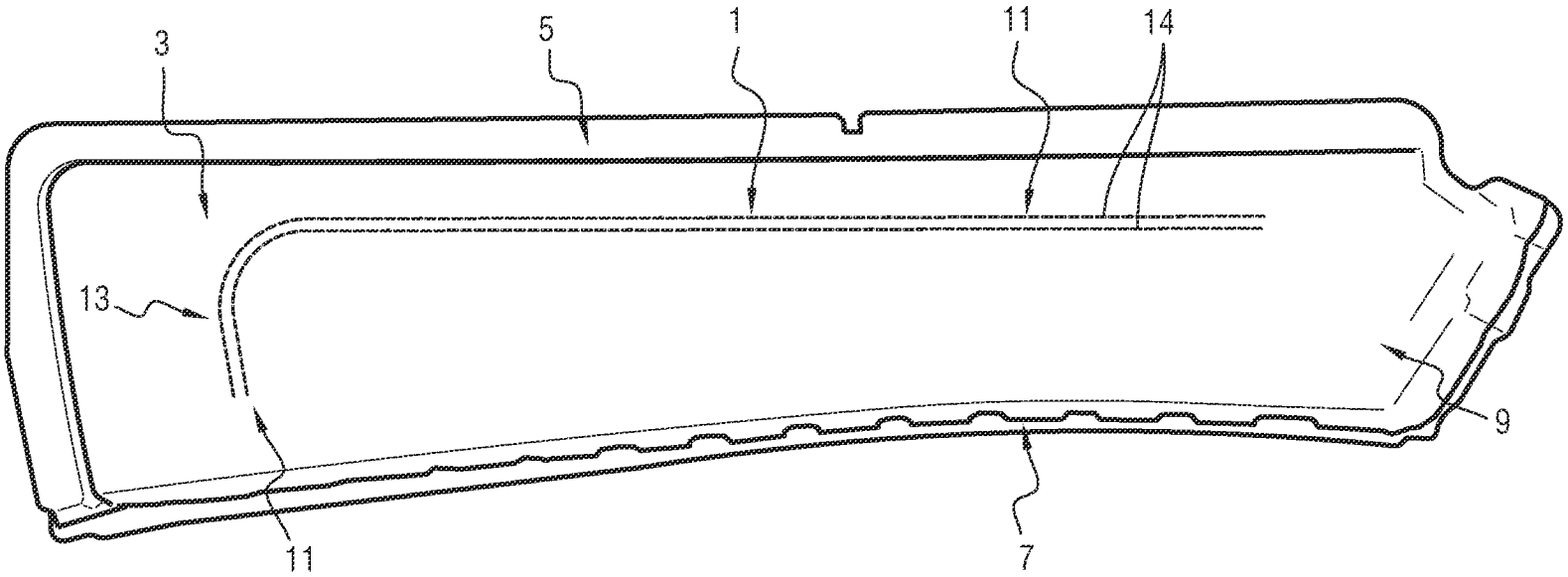
FIG. 1 is a top view of a part obtained using embodiments of the assembly and method of the invention.

The assembly and method are adapted for making a seam 1 along a determined path on a surface 3 of the part 5, as illustrated in FIG. 1.

The surface 3 is typically the surface of the part 5 visible to passengers.

The part 5 comprises a substrate 7 and a decorative layer 9 for example covering the substrate 7 and defining said surface 3.

The substrate 7 is made of polypropylene (PP), acrylonitrile butadiene styrene (ABS), natural fibers for example, or any other suitable material. The substrate 7 comprises a thickness of between 1.5 and 4 mm, for example.

The decorative layer 9 is made of polyvinyl chloride (PVC), thermoplastic olefin (TPO), for example, or any other suitable material. The decorative layer 9 comprises a thickness of between 1 and 5 mm, for example.

The seam 1 runs through the entire part, that is, through both the substrate 7 and the decorative layer 9.

In some cases, the surface 3 comprises a pattern, for example a decorative pattern with lines or surfaces bounded by edges. In this case, the seam 1 advantageously follows said lines or edges.

In a variant, the part 5 does not comprise a substrate 7 and comprises only the decorative layer 9.

The path of the seam 1 is of any suitable type. It comprises, for example, at least one straight section 11 and/or at least one curved section 13.

In the example shown in FIG. 1, the path comprises two straight sections 11, connected to each other by a curved section 13.

In a variant, the path comprises more than two straight sections 11, for example three or more straight sections 11, and/or comprises more than one curved section 13, for example two or more curved sections 13.

The seam 1 is of any suitable type.

For example, it comprises two seam lines 14, parallel to each other. In a variant, it comprises only one seam line, or more than two seam lines parallel to each other.

Figure 2:
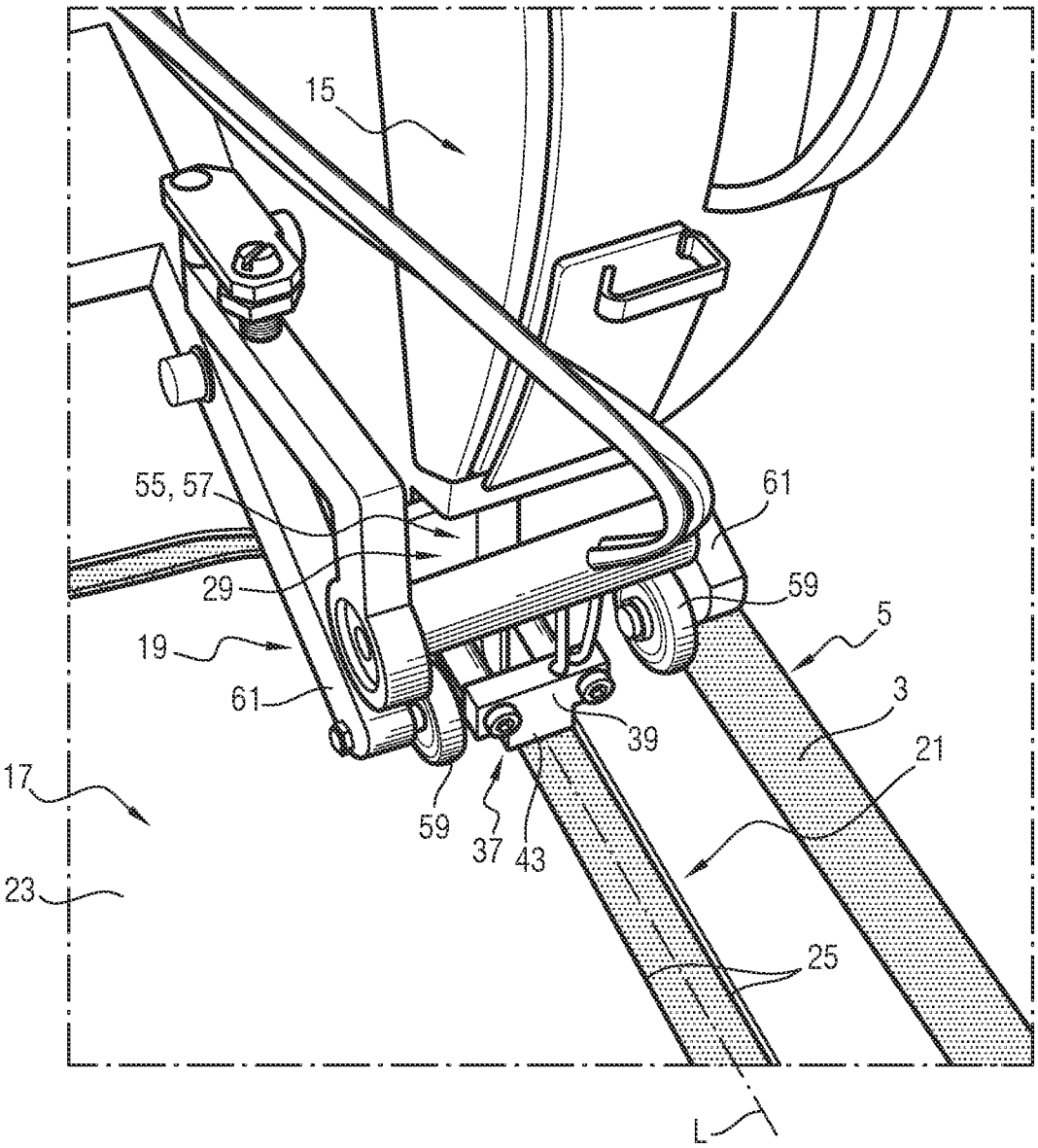
FIG. 2 is a perspective view of a sewing assembly according to an embodiment of the invention.

The sewing assembly 15 comprises a mask 17 adapted to be attached to the part 5 and a sewing machine 19 (FIG. 2).

The mask 17 comprises a longitudinally elongated through guide groove 21, adapted to be superimposed on said layout.

The mask 17 is a stiff sheet.

It is placed on the surface 3 and is pressed against this surface 3.

The mask 17 thus comprises a lower face placed on the surface 3. The lower face is in contact over substantially its entire surface with the surface 3 of the part 5. To do so, it comprises the same shape as the surface 3. Thus, if the surface 3 is flat, the bottom side of the mask 17 is also flat. If the surface 3 is raised, the bottom side 3 is also raised. By this, it is meant that it is three-dimensional, with recessed and projecting portions.

The mask 17 is made of any suitable material. It is typically made of a metal or plastic: for example, aluminum or aluminum alloy, polycarbonate, polyamide, polypropylene, PLA (polylactic acid) etc.

The groove 21 passes through the mask 17 over its entire thickness. It is open on the lower side and also on the upper side 23 of the mask 17.

The groove 21 has the same shape as the pattern, that is, as the seam 1.

The groove 21 is delimited by two longitudinal edges 25 parallel to each other.

The groove 21 has a substantially constant internal transverse width. This transverse width is taken between the two longitudinal edges 25.

The width of the groove is typically between 8 and 15 mm.

The groove 21 comprises a longitudinal centerline L, following the path.

The cross-section of the groove 21, taken perpendicular to the centerline L, is substantially rectangular. It is substantially constant along the entire longitudinal length of the groove 21.

The mask 17 is fixed to the part 5 in a reversible manner, by any suitable means:

adhesive tape, Velcro© tape, mechanical clamps, etc. It is rigidly attached to the part 5, so that no movement of the mask 17 in relation to the part 5 is possible during the sewing operation.

The sewing machine 19 comprises a base 27 (FIG. 3) and a head 29 arranged above the base 27.

Top and bottom are understood here in the vertical direction.

The part 5 fitted with the mask 17 is adapted to be received between the base 27 and the head 29, with the mask 17 turned towards the head 29 as shown in FIG. 2.

Figure 3:
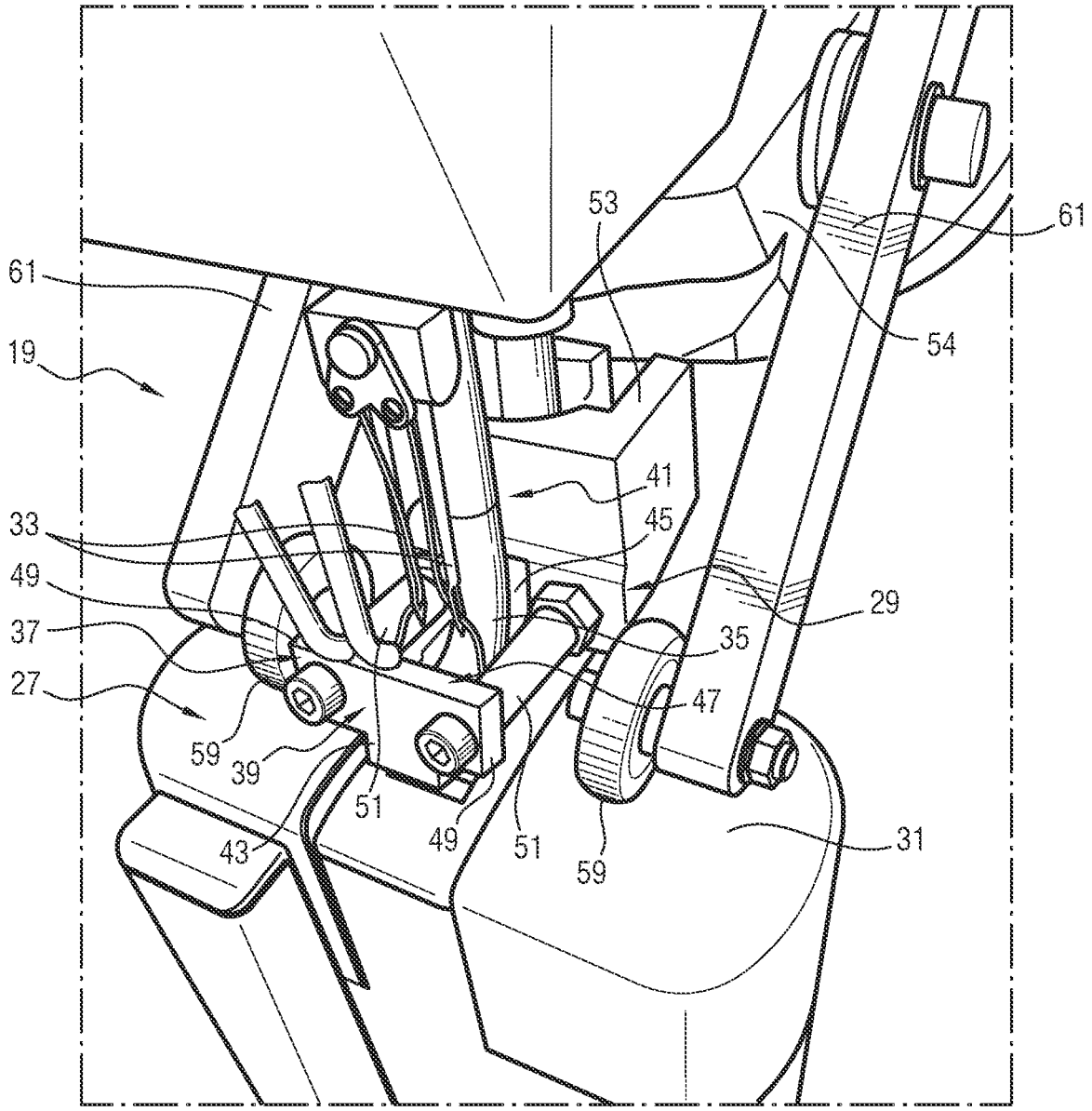
FIG. 3 is a perspective view of the sewing machine of the sewing assembly of FIG. 2.

The base 27 comprises an upwardly support surface 31 turned upwards (FIG. 3). The part 5 fitted with the mask 17 rests on the support surface 31 during the sewing operation. The part 5 rests on the surface 31 by a support surface opposite the surface 3.

The head 29 comprises at least one needle 33, a foot 35 for supporting the part 5 and a guide 37 (FIG. 3).

The at least one needle 33 is arranged to produce the seam 1. For this purpose, it interacts with a mechanism housed in the base 27, not visible in the figures.

In the example shown, the head 29 comprises two needles 33, each adapted to produce one of the two seam lines 14. In a variant, the head 29 comprises a single needle 33 or more than two needles 33.

The needles 33 and the base mechanism interacting with the needles 33 are of a known type and will not be described in detail here.

The guide 37 comprises a front guide 39 and a rear guide 41 arranged to interact with the mask 17 and spaced from each other along the guide groove 21 (FIG. 2).

The at least one needle 33 and the support foot 35 are engaged in the groove 21 between the front guide 39 and the rear guide 41. The part 5 is guided in its movement relative to the base 27 by interaction of the front guide 39 and the rear guide 41 with the mask 17.

Advantageously, the front guide 39 and the rear guide 41 are both engaged in the guide groove 21.

The part 5 is guided in its movement relative to the base 27 by interaction of the front guide 39 and the rear guide 41 with the guide groove 21.

In a variant, the front guide 39 and the rear guide 41 interact with another part of the mask 17, for example ribs parallel to the guide groove 21.

In order to guide, the front guide 39 and the rear guide 41 preferably comprise a front slide 43 and a rear slide 45 respectively engaged in the groove 21.

The front slide 43 and the rear slide 45 each have an outer width substantially equal to the inner width of the groove 21.

The front guide 39 and the rear guide 41 are identical in shape. Only the front guide is completely visible in the figures.

Each guide 39, 41 has a general T shape, with a horizontal leg 47. The T shape extends in a substantially vertical plane.

The slide 43, 45 extends downward from a central portion of the horizontal leg 47. End portions 49 of the horizontal leg 47 project horizontally on either side of the slide 43, 45.

The end portions 49 rest on the edges 25 of the slot 21 when the front and rear guides 39, 41 are engaged in the slot 21.

The front slide 43 and the rear slide 45 each have a rectangular shape, substantially joined to the cross-section of the groove 21 taken perpendicular to the centerline L.

Furthermore, the head 19 comprises two rods 51 arranged on either side of the groove 21 and connecting the front guide 39 and the rear guide 41 to each other.

The two rods 51, the front guide 39 and the rear guide 41 together constitute a rigid frame. The at least one needle 33 and the support foot 35 are arranged inside this frame.

The front guide 39 and the rear guide 41 are integral with the chassis 53 of the head 29.

This chassis 53, also called the guide block, is connected to an axis of the machine.

The machine also comprises a fixed block 54, which is rigidly attached to the fixed frame of the machine. This fixed block is made of wood for example. It is typically arranged to prevent rotation of the guide block about the axis, especially when the seams are curved. The fixed block is arranged to allow the movable block to rest against it so as not to rotate.

The sewing machine 19 further comprises a mechanism 55 for advancing the part 5, comprising the support foot 35 and a drive 57 configured to bring the support foot 35 to bear on the part 5 and move the part 5 longitudinally in a rear direction relative to the base 27.

Typically, the drive 57 includes a counter-brace (not visible in the figures) housed in the base 27, opposite the support foot 35. The drive 57 is configured to periodically bring the counter-brace into contact with the bearing surface of the part 5. The drive 57 is configured to periodically bring the support foot 35 into contact with the surface 3 of the part 5, through the groove 21, simultaneously and synchronously with the counter-brace.

The part 5 is thus periodically clamped between the support foot 35 and the counter support.

Once the part 5 is clamped, the drive 57 is configured to lift it off the base 27 via the counter-brace, and move it relative to the base 27 longitudinally backwards, that is, towards the rear guide 41. To do this, the drive 57 moves the support foot 35 and the counter-brace longitudinally backwards by one step relative to the chassis 53 of the head 29.

This movement is synchronized with the movement of the at least one needle 33.

This movement causes the edges 25 of the groove 21 to slide against the front guide 39 and the rear guide 41.

Once the one-step backward movement has occurred, the drive 57 is configured to move the support foot 35 and the counter-brace away from the part 5, and to return the support foot 35 and the counter-brace longitudinally forward one step to their initial positions relative to the chassis 53 and the base 27.

The contact between the end portions 49 and the edges 25 of the groove 21 ensures that the part 5 is held against the base 27 when the feed mechanism releases the pressure between the foot 35 and the counter-brace.

The sewing machine 19 further comprises at least one roller 59 for pressing the part 5 against the base 27, resting on the mask 17.

Preferably, the sewing machine 19 comprises two pressure rollers 59 arranged transversely on either side of the groove 21, as illustrated in FIG. 2.

The rollers 59 apply the part 5 and the mask 17 flexibly against the base 27. The pressure exerted by the rollers 59 is adjusted so as to not prevent the mechanism 55 from lifting and advancing the part 5 and the mask 17.

The or each roller 59 is rotatably mounted at the proximal end of an arm 61, about a transverse axis. The distal end of the arm 61 is pivotally mounted on the fixed frame of the machine, for example on the fixed block 54, about an axis that is also transverse. A flexible member not shown makes the arm 61 rotate relative to the fixed frame about its axis, in a direction such that the roller 59 is made to bear against the part 5. This member is for example a torsion spring. The force applied by the spring member is adjustable.

With the sewing assembly 15, the movement of the part 5 during the sewing operation is entirely autonomous. The part 5 does not have to be guided by an operator. The guidance obtained by the interaction of the front and rear guides 39, 41 with the groove 21 is sufficiently precise, even when the seam pattern includes curves. The mechanism 55 moves the part without human intervention.

The roller(s) 59 limit the pulses of the part 5 during its movement, and improve the precision of the seam. Indeed, the part 5 generally comprises a large overhang in relation to the base 27, and the movement steps can cause the part to oscillate around the contact area with the base. These oscillations or pulses are reduced by the roller or rollers 59.

The sewing method will now be detailed.

This method is especially adapted to be implemented by the sewing assembly 15 described above. Conversely, the sewing assembly 15 is specially adapted to implement the sewing method to be described below.

This method is adapted for sewing a seam 1 along a determined path on a surface 3 of a part 5, as explained above.

The sewing method comprises the following steps:

- attaching a mask 17 to the part 5, the mask 17 having a longitudinally elongated through guide groove 21 superimposed on said path,
- placing the part 5 fitted with the mask 17 in a sewing machine 19 comprising a base 27 and a head 29 arranged above the base 27, the part 5 with the mask 17 being received between the base 27 and the head 29 with the mask 17 turned towards the head 29, the head 29 comprising at least one needle 33, a support foot 35 on the part 5 and a guide 37, the guide 35 comprising a front guide 39 and a rear guide 41 interacting with the mask 17 and spaced apart from each other along the guide groove 21, the at least one needle 33 and the support foot 35 being engaged in the groove 21 between the front guide 39 and the rear guide 41 moving the part 5 and the mask 17 in relation to the base 27 and making the seam 1 with the at least one needle 33, the part 5 being guided in its movement by interaction of the front guide 39 and the rear guide 41 with the mask 17.

The part 5 is of the type described above.

The seam 1 to be produced is as described above.

The mask 17, in particular the groove 21, is as described above.

The sewing machine 19, in particular the base 27 and the head 29, is as described above.

The front guide 39 and a rear guide 41 are advantageously engaged with each other in the guide groove 21. The part 5 is then guided in its movement by interaction of the front guide 39 and the rear guide 41 with the guide groove 21.

The part 5 and the mask 17 in the movement stage are moved relative to the base 27 by bringing the support foot 35 to bear on the part 5 and moving the part 5 and the mask 17 longitudinally in a rear direction relative to the base 27.

This is preferably achieved by means of a mechanism 55 for advancing the part 5 of the type described above, comprising the support foot 35 and a drive 57 comprising a counter-brace.

The part 5 is thus periodically clamped between the support foot 35 and the counter-brace.

Once the part 5 is clamped, the part 5 is lifted from the base 27 via the counter-brace, and moved relative to the base 27 longitudinally towards the rear, that is, towards the rear guide 41. To do this, the drive 57 moves the support foot 35 and the counter-brace longitudinally backwards by one step relative to the chassis 53 of the head 29.

This movement causes the edges 25 of the groove 21 to slide against the front guide 39 and the rear guide 41.

Once the one-step backward movement is completed, the support foot 35 and the counter-brace are moved away from the part 5, and the support foot 35 and the counter-brace are moved longitudinally forward one step to their original positions relative to the chassis 53 and the base 27.

The sewing is done by the at least one needle 33, synchronously with the movement of the part 5.

During the movement step, the part 5 is pressed against the base 27 by at least one roller 59 pressing on the mask 17, preferably two pressure rollers 59 arranged transversely on either side of the groove 21.

These rollers 59 are as described above.

The ends of the thread used for the seams are advantageously fixed to the non-visible face of the part via a knot or an adhesive.

According to a variant embodiment, particularly adapted to the case where the part does not comprise a substrate 7 and where the decorative layer 9 is not rigid, the sewing assembly comprises two masks: one above the part, and one below the part, to ensure a certain consistency in the shape of the part during sewing. A groove is provided in each mask opposite the seam path.

The invention claimed is:

1. A sewing assembly for making a seam along a predetermined path on a surface of a part, the sewing assembly comprising a mask adapted to be attached to the part and a sewing machine, the mask being a sheet and having a longitudinally elongated guide groove formed through the sheet and adapted to be superimposed on said path, the sewing machine comprising:

a base; and a head arranged above the base, the part fitted with the mask being adapted to be received between the base and the head with the mask turned towards the head, the head comprising at least one needle, a part support foot and a guide, the guide comprising a front guide and a rear guide arranged to interact with the mask, the front guide and the rear guide being separate components and longitudinally spaced apart from each other along the guide groove, the at least one needle and the support foot being engaged in the groove between the front guide and the rear guide.

2. The assembly according to claim 1, wherein the front guide and the rear guide are both engaged in the guide groove.

3. The assembly according to claim 2, wherein the groove has a determined transverse internal width, the front guide and the rear guide comprising respectively a front slide and a rear slide engaged in the guide groove and having an external width substantially equal to the internal width of the groove.

4. The assembly according to the claim 1, wherein the head comprises two rods arranged on either side of the groove and connecting the front guide and the rear guide to each other, the two rods, the front guide and the rear guide together constituting a rigid frame.

5. The assembly according to the claim 1, wherein the sewing machine comprises a mechanism for advancing the part comprising the support foot and a drive configured to bring the support foot to rest on the part and move the part longitudinally in a rear direction relative to the base.

6. The assembly according to the claim 1, wherein the sewing machine comprises at least one roller for pressing the part against the base, resting on the mask.

7. The assembly according to the claim 6, wherein the sewing machine comprises two pressure rollers for pressing the part against the base, resting on the mask, the two pressure rollers being arranged transversely on either side of the groove.

8. The assembly according to claim 1, wherein the head comprises a chassis, the front guide and the rear guide being integral with the chassis of the head, the chassis being connected to an axis of the sewing machine, the support foot being movable relative to the chassis for advancing the part.

9. The assembly according to claim 8, wherein the support foot is movable relative to the front guide and the rear guide for advancing the part relative to the front guide and the rear guide, the front guide and the rear guide cooperating with the guide groove to guide displacement of the part in relation to the chassis.

10. The assembly according to claim 1, wherein each of the front guide and the rear guide has a T-shape comprising a horizontal leg and a slide extending downward from a central portion of the horizontal leg.

11. The assembly according to claim 10, wherein end portions of the horizontal leg project horizontally on either side of the slide, the end portions resting on edges of the guide groove when the front and rear guides are engaged in the guide groove.

12. The assembly according to the claim 1, wherein the sewing machine comprises two pressure rollers resting on the mask and arranged transversely on either side of the groove for pressing the part against the base.

13. A sewing method for sewing a seam along a predetermined path on a surface of a part, the sewing method comprising the following steps using the sewing assembly of claim 1:

attaching the mask to the part;

placing the part fitted with the mask in the sewing machine between the base and the head with the mask turned towards the head, the front guide and the rear guide interacting with the mask and spaced apart from each other along the guide groove, the at least one needle and the part support foot being engaged in the guide groove between the front guide and the rear guide; and moving the part and the mask relative to the base and sewing the seam with the at least one needle, the part being guided in its movement by interaction of the front guide and the rear guide with the mask.

14. The method according to claim 13, wherein the front guide and the rear guide are both engaged in the guide groove, the part being guided in its movement by interaction of the front guide and the rear guide with the guide groove.

15. The method according to claim 13, wherein the part and the mask are moved relative to the base by bringing the support foot into contact with the part and moving the part and the mask longitudinally in a rear direction relative to the base.

16. The method according to the claim 13, wherein the part is pressed against the base by at least one pressure roller bearing on the mask.

17. The method according to claim 16, wherein the part is pressed against the base by two pressure rollers bearing on the mask, arranged transversely on either side of the groove.

18. The method according to the claim 13, wherein the part comprises a substrate and a decorative layer covering the substrate and defining said surface.

19. A sewing assembly for making a seam along a predetermined path on a surface of a part, the sewing assembly comprising a mask adapted to be attached to the part and a sewing machine, the mask being a sheet and having a longitudinally elongated guide groove formed through the sheet and adapted to be superimposed on said path, the sewing machine comprising:

a base; and a head arranged above the base, the part fitted with the mask being adapted to be received between the base and the head with the mask turned towards the head, the head comprising at least one needle, a part support foot and a guide, the guide comprising a front guide and a rear guide arranged to interact with the mask and spaced apart from each other along the guide groove, the at least one needle and the support foot being engaged in the groove between the front guide and the rear guide, wherein the head comprises two rods arranged on either side of the groove and connecting the front guide and the rear guide to each other, the two rods, the front guide, and the rear guide together constituting a rigid frame.

* * * * *